US009680223B2

(12) United States Patent
Wu et al.

(10) Patent No.: US 9,680,223 B2
(45) Date of Patent: Jun. 13, 2017

(54) MOBILE DEVICE AND MANUFACTURING METHOD THEREOF

(71) Applicant: HTC Corporation, Taoyuan, Taoyuan County (TW)

(72) Inventors: Chun-Yih Wu, Taoyuan (TW); Yen-Liang Kuo, Taoyuan (TW); Chien-Chih Chen, Taoyuan (TW)

(73) Assignee: HTC CORPORATION, Taoyuan (TW)

( * ) Notice: Subject to any disclaimer, the term of this patent is extended or adjusted under 35 U.S.C. 154(b) by 338 days.

(21) Appl. No.: 14/316,050

(22) Filed: Jun. 26, 2014

(65) Prior Publication Data

US 2015/0380820 A1 Dec. 31, 2015

(51) Int. Cl.

| | |
|---|---|
| ***H01Q 1/24*** | (2006.01) |
| ***H01Q 5/378*** | (2015.01) |
| ***H01Q 9/42*** | (2006.01) |
| ***H01Q 5/392*** | (2015.01) |

(52) U.S. Cl.

CPC ..... *H01Q 5/378* (2015.01); *H01Q 1/243* (2013.01); *H01Q 5/392* (2015.01); *H01Q 9/42* (2013.01)

(58) Field of Classification Search

CPC H01Q 5/378; H01Q 9/30; H01Q 1/24; H01Q 1/38; H01Q 1/44; H01Q 5/314; H01Q 13/10; H01Q 1/52; H01Q 9/0421; H01Q 1/241–1/244

See application file for complete search history.

(56) References Cited

U.S. PATENT DOCUMENTS

| | | | | |
|---|---|---|---|---|
| 5,061,943 | A * | 10/1991 | Rammos | H01Q 1/38 343/770 |
| 8,952,851 | B1 * | 2/2015 | Hsu | H01Q 9/0421 343/700 MS |
| 9,008,738 | B1 * | 4/2015 | Dong | A45C 11/00 455/575.1 |
| 9,252,494 | B2 * | 2/2016 | Hayashi | H01Q 9/42 |
| 2005/0078043 | A1 * | 4/2005 | Apostolos | H01Q 13/10 343/767 |
| 2009/0002130 | A1 * | 1/2009 | Kato | G06K 19/07749 340/10.1 |
| 2010/0283706 | A1 * | 11/2010 | Tsao | B29C 45/14639 343/872 |

(Continued)

OTHER PUBLICATIONS

Chen et al., "Planar Strip Monopole with a Chip-Capacitor-Loaded Loop Radiating Feed for LTE/WWAN Slim Mobile Phone Application," Microwave and Optical Technology Letters, vol. 53, No. 4, Apr. 2011, pp. 952-958.

(Continued)

*Primary Examiner* — Jessica Han
*Assistant Examiner* — Awat Salih
(74) *Attorney, Agent, or Firm* — Birch, Stewart, Kolasch & Birch, LLP

(57) ABSTRACT

A mobile device includes a ground plane, a first radiation branch, and a second radiation branch. The second radiation branch is coupled to the ground plane, and is disposed adjacent to the first radiation branch. An antenna structure is formed by the first radiation branch and the second radiation branch. The first radiation branch is fed from a signal source. The second radiation branch is excited by the first radiation branch through coupling therebetween.

23 Claims, 14 Drawing Sheets

(56) References Cited

U.S. PATENT DOCUMENTS

2012/0001815 A1* 1/2012 Wong ..... H01Q 1/243 343/749
2012/0044114 A1* 2/2012 Eom ..... H01Q 1/243 343/702
2012/0256800 A1* 10/2012 Kuonanoja ..... H01Q 1/243 343/749
2012/0313827 A1* 12/2012 Kim ..... H01Q 1/243 343/702
2013/0127674 A1 5/2013 Korva
2014/0015724 A1* 1/2014 Bungo ..... H01Q 13/10 343/767
2014/0055305 A1* 2/2014 Lin ..... H01Q 1/22 343/702
2014/0132458 A1* 5/2014 Teng ..... H01Q 1/243 343/702
2014/0193023 A1* 7/2014 Heo ..... H01Q 1/2283 381/391
2014/0347242 A1* 11/2014 Seo ..... H01Q 1/48 343/848
2014/0361086 A1* 12/2014 Finn ..... B05D 3/06 235/488
2015/0137742 A1* 5/2015 Tseng ..... H02J 7/0042 320/108
2015/0222008 A1* 8/2015 Cooper ..... H01Q 1/243 343/702
2015/0349407 A1* 12/2015 Nishizaka ..... H01Q 1/243 343/702
2016/0111771 A1* 4/2016 Su ..... H01Q 1/243 343/702

OTHER PUBLICATIONS

Chen et al., "Wideband Monopole Antenna Coupled with a Chip-Inductor-Loaded Shorted Strip for LTE/WWAN Mobile Handset," Microwave and Optical Technology Letters, vol. 53, No. 6, Jun. 2011, pp. 1293-1298.

Kang et al., "Simple Small-Size Coupled-Fed Uniplanar PIFA for Multiband Clamsheel Mobile Phone Application," Microwave and Optical Technology Letters; vol. 51, No. 2, Dec. 2009, pp. 2805-2810.

* cited by examiner

MOBILE DEVICE AND MANUFACTURING METHOD THEREOF

BACKGROUND OF THE INVENTION

Field of the Invention

The subject application generally relates to a mobile device, and more specifically, to a mobile device including an antenna structure.

Description of the Related Art

With the advancement of mobile communication technology, mobile devices such as portable computers, mobile phones, multimedia players, and other hybrid functional portable electronic devices have become more common. To satisfy the demands of users, mobile devices can usually perform wireless communication functions. Some devices cover a large wireless communication area; these include mobile phones using 2G, 3G, and LTE (Long Term Evolution) systems and using frequency bands of 700 MHz, 850 MHz, 900 MHz, 1800 MHz, 1900 MHz, 2100 MHz, 2300 MHz, and 2500 MHz. Some devices cover a small wireless communication area; these include mobile phones using Wi-Fi, Bluetooth, and WiMAX (Worldwide Interoperability for Microwave Access) systems and using frequency bands of 2.4 GHz, 3.5 GHz, 5.2 GHz, and 5.8 GHz.

Antennas are indispensable elements of mobile devices for wireless communication. However, the drawback is that the antennas tend to be affected by nearby metal elements. For example, metal back covers are usually incorporated into mobile devices because current mobile devices are required to have beautiful, thin appearance. If the metal back covers are disposed adjacent to the antennas, they will negatively affect the radiation performance of the antennas and significantly degrade the communication quality of the mobile devices.

BRIEF SUMMARY OF THE INVENTION

In a preferred embodiment, the subject application is directed to a mobile device, including: a ground plane; a first radiation branch; and a second radiation branch, coupled to the ground plane, and disposed adjacent to the first radiation branch; wherein an antenna structure is formed by the first radiation branch and the second radiation branch, the first radiation branch is fed from a signal source, and the second radiation branch is excited by the first radiation branch through coupling therebetween.

In some embodiments, the mobile device further includes: a metal back cover, disposed opposite to the ground plane; and one or more shorting pins, wherein the metal back cover is coupled through the shorting pins to the ground plane. In some embodiments, the metal back cover includes two separate portions, and at least one opening is formed between the portions of the metal back cover. In some embodiments, the opening substantially has a rectangular shape, and the opening is used to accommodate a camera lens, an NFC (Near Field Communication) coil, a flash light module, a biometric identification module, or a wireless charging coil. In some embodiments, the mobile device further includes: a first circuit element, embedded in the first radiation branch. In some embodiments, the first circuit element includes a capacitor and a first inductor, and the capacitor is coupled in parallel to the first inductor. In some embodiments, the capacitor is a variable capacitor. In some embodiments, the mobile device further includes: a second circuit element, wherein one end of the second radiation branch is coupled through the second circuit element to the ground plane. In some embodiments, the second circuit element includes a second inductor. In some embodiments, the first radiation branch substantially has an L-shape. In some embodiments, the second radiation branch substantially has an L-shape. In some embodiments, a width of a coupling gap between the first radiation branch and the second radiation branch is shorter than 6 mm. In some embodiments, the ground plane is disposed on a PCB (Printed Circuit Board), or is implemented with a display-carrying element. In some embodiments, the ground plane substantially has a rectangular shape with a narrow and long concave region, and the narrow and long concave region is a metal-free region adjacent to the second radiation branch. In some embodiments, at least one portion of the second radiation branch is disposed within the narrow and long concave region. In some embodiments, the mobile device further includes: a second circuit element, wherein one end of the second radiation branch is coupled through the second circuit element to the ground plane, and spacing between a short edge of the narrow and long concave region and the end of the second radiation branch is at least 3 mm. In some embodiments, the first radiation branch is disposed on a first plane, the second radiation branch is disposed on a second plane and a third plane, and the second plane and the third plane are both perpendicular to the first plane. In some embodiments, the first radiation branch is disposed on a PCB (Printed Circuit Board). In some embodiments, at least one portion of the second radiation branch is implemented with a side appearance element. In some embodiments, the side appearance element is an extension portion of a display-carrying element. In some embodiments, the side appearance element is an extension portion of a metal back cover. In some embodiments, the antenna structure is configured to cover a first band and a second band, the first band is from about 698 MHz to about 960 MHz, and the second band is from about 1710 MHz to about 2690 MHz.

In a preferred embodiment, the invention is directed to a method for manufacturing a mobile device, including the steps of: providing a ground plane, a first radiation branch, and a second radiation branch; coupling the second radiation branch to the ground plane, wherein the second radiation branch is disposed adjacent to the first radiation branch; and using the first radiation branch and the second radiation branch to form an antenna structure, wherein the first radiation branch is fed from a signal source, and the second radiation branch is excited by the first radiation branch through coupling therebetween.

In some embodiments, the method further includes: providing a metal back cover, wherein the metal back cover is disposed opposite to the ground plane; and coupling the metal back cover through one or more shorted-circuit elements to the ground plane. In some embodiments, the method further includes: embedding a first circuit element in the first radiation branch; and coupling one end of the second radiation branch through a second circuit element to the ground plane. In some embodiments, the first circuit element includes a capacitor and a first inductor, the capacitor is coupled in parallel to the first inductor, and the second circuit element includes a second inductor.

In a preferred embodiment, the invention is directed to method for manufacturing a mobile device, including the steps of: providing a first radiation branch, a second radiation branch, and a display-carrying element, wherein a ground plane is formed by the display-carrying element, the display-carrying element at least has a narrow and long concave region, and the first radiation branch is printed on a FPCB (Flexible Printed Circuit Board); fixing the FPCB on a plastic supporting region of the display-carrying element, wherein the FPCB is disposed adjacent to the second radiation branch; and using the first radiation branch and the second radiation branch to form an antenna structure, wherein the first radiation branch is fed from a signal source, and the second radiation branch is excited by the first radiation branch through coupling therebetween.

BRIEF DESCRIPTION OF DRAWINGS

The subject application can be more fully understood by reading the subsequent detailed description and examples with references made to the accompanying drawings, wherein.

DETAILED DESCRIPTION OF THE INVENTION

In order to illustrate the purposes, features and advantages of the invention, the embodiments and figures of the invention are shown in detail as follows.

Figure 1A:
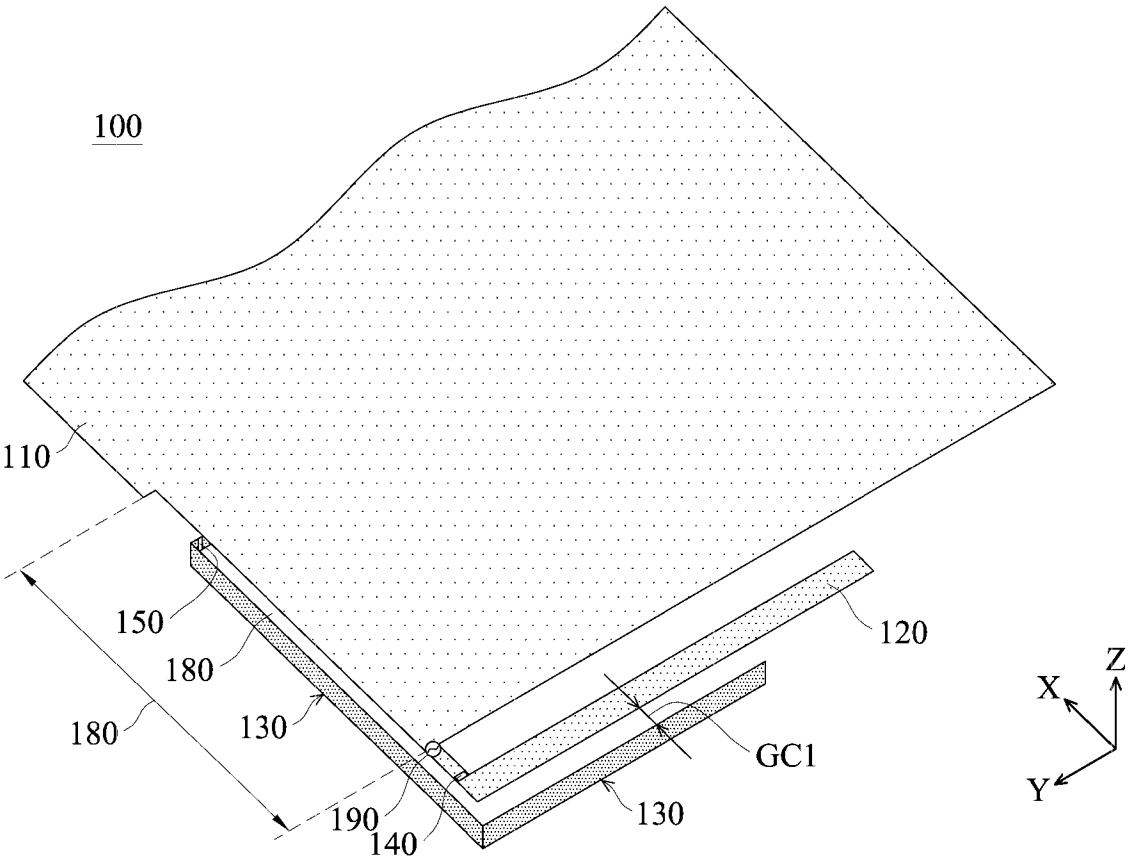
FIG. 1A is a perspective view of a mobile device according to an embodiment of the invention.
Figure 1B:
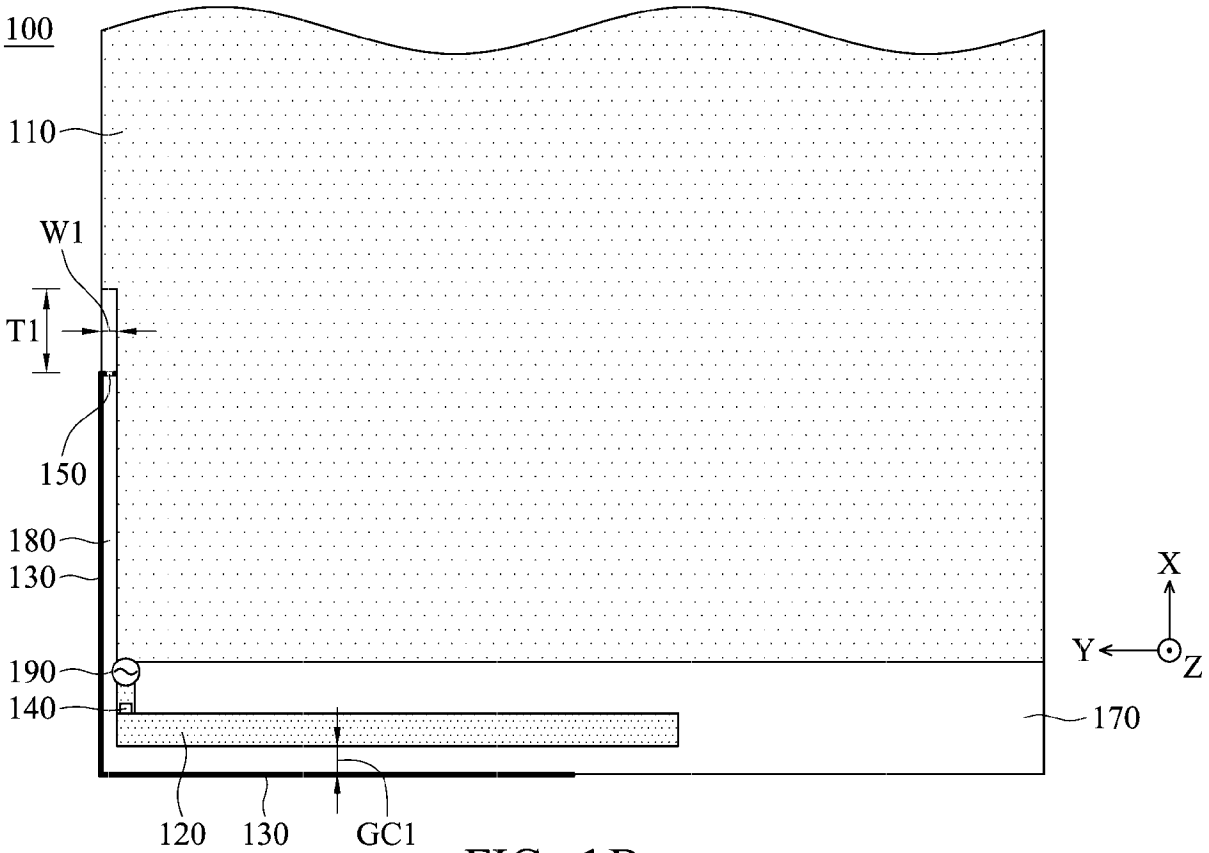
FIG. 1B is a top view of a mobile device according to an embodiment of the invention.

FIG. 1A is a perspective view of a mobile device 100 according to an embodiment of the invention. FIG. 1B is a top view of the mobile device 100 according to an embodiment of the invention. Please refer to FIG. 1A and FIG. 1B together. The mobile device 100 may be a smartphone, a tablet computer, or a notebook computer. The mobile device 100 at least includes a ground plane 110, a first radiation branch 120, and a second radiation branch 130. The above components of the mobile device 100 may be made of conductive materials, such as silver, copper, iron, aluminum, or alloys thereof. It should be understood that the mobile device 100 may further include other components, such as a processor, a display device, a power supply module, a touch control module, a transceiver, a signal processing module, a speaker, and/or a housing (not shown).

Figure 7B:
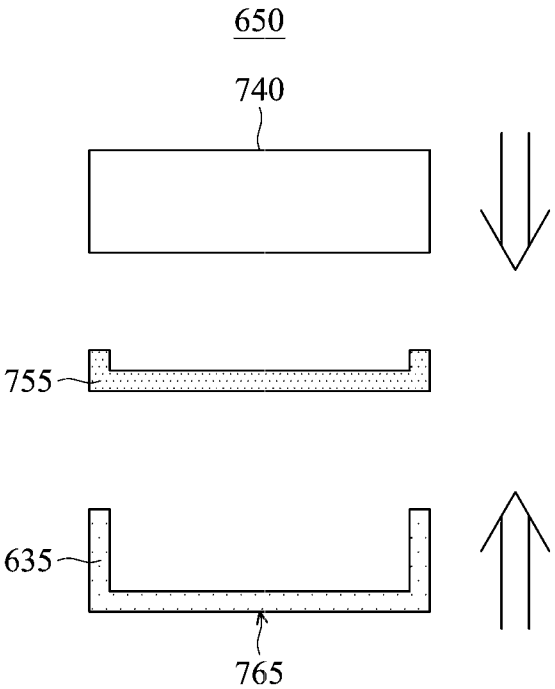
FIG. 7B is an exploded side view of a mobile device according to an embodiment of the invention.

The ground plane 110, the first radiation branch 120, and the second radiation branch 130 may be disposed on a PCB (Printed Circuit Board) 170. However, the invention is not limited to the above. In alternative embodiments, the ground plane 110 and the second radiation branch 130 are implemented with a display-carrying element (not shown), and the display-carrying element is made of conductive materials. In other embodiments, the first radiation branch 120 and the second radiation branch 130 are disposed on an inner side of a plastic housing (not shown) by using an LDS (Laser Direct Structuring) process, or are disposed on a FPCB (Flexible Printed Circuit Board) (not shown). The FPCB may be supported by a plastic supporting region (as shown in FIG. 7C). The second radiation branch 130 is coupled to the ground plane 110, and is disposed adjacent to the first radiation branch 120. An antenna structure is formed by the first radiation branch 120 and the second radiation branch 130. The first radiation branch 120 is fed from a signal source 190, and the second radiation branch 130 is excited by the first radiation branch 120 through mutual coupling therebetween. The signal source 190 may be an RF (Radio Frequency) module of the mobile device 100. A positive electrode of the signal source 190 is coupled to one end of the first radiation branch 120, and a negative electrode of the signal source 190 is coupled to the ground plane 110. In order to enhance the mutual coupling effect, the width of a coupling gap GC1 between the first radiation branch 120 and the second radiation branch 130 may be designed to be shorter than 6 mm. In some embodiments, the first radiation branch 120 substantially has an L-shape, and is disposed on a first plane (e.g., the first plane may be parallel to XY-plane of FIGS. 1A and 1B). In some embodiments, the second radiation branch 130 substantially has an L-shape, and is disposed on a second plane and a third plane (e.g., the second plane and the third plane may be parallel to XZ-plane and YZ-plane of FIGS. 1A and 1B, respectively). The second plane and the third plane may both be perpendicular to the first plane. In other words, the first radiation branch 120 and the second radiation branch 130 may form a three-dimensional antenna structure which is consistent with the contour of the ground plane 110. Accordingly, the above design has the advantage of minimizing the whole antenna size, and the proposed antenna structure of the invention will not occupy much inner design space of the mobile device 100.

More particularly, the ground plane 110 substantially has a rectangular shape, and may be formed on the PCB 170 (i.e., the metal region covered by copper foils). The ground plane 110 has a narrow and long concave region 180, which is substantially rectangular and has a long edge and a short edge (L1×W1). The narrow and long concave region 180 is a metal-free region adjacent to the second radiation branch 130. At least one portion of the second radiation branch 130 may be further disposed within the narrow and long concave region 180. In some embodiments, the narrow and long concave region 180 has a thin and long rectangular shape, which is formed at a corner of the ground plane 110. The narrow and long concave region 180 can provide a clearance region to maintain the radiation performance of the second radiation branch 130. It should be understood that without the narrow and long concave region 180, the second radiation branch 130 may protrude outside the PCB 170 and occupy additional design space in the mobile device 100. In some embodiments, the narrow and long concave region 180 may be formed by cutting a thin, long rectangular portion from the PCB 170. With the design of the narrow and long concave region 180, the whole antenna size can be further reduced.

As to the antenna theory, the first radiation branch 120 of the antenna structure can be excited to generate a first low-frequency resonant mode and a first high-frequency resonant mode, and the second radiation branch 130 of the antenna structure can be excited to generate a second low-frequency resonant mode and a second high-frequency resonant mode. When the first radiation branch 120 and the second radiation branch 130 have similar resonant lengths, the first low-frequency resonant mode can be combined with the second low-frequency resonant mode, and the first high-frequency resonant mode can be combined with the second high-frequency resonant mode. More particularly, the first low-frequency resonant mode is close to and slightly higher than the second low-frequency resonant mode, and the first high-frequency resonant mode is close to and slightly higher than the second high-frequency resonant mode. Accordingly, the antenna structure can at least cover a low wideband and a high wideband. In a preferred embodiment, the mobile device 100 and the antenna structure of the invention can support LTE (Long Term Evolution) and WWAN (Wireless Wide Area Network) multi-band operations.

Figure 1C:
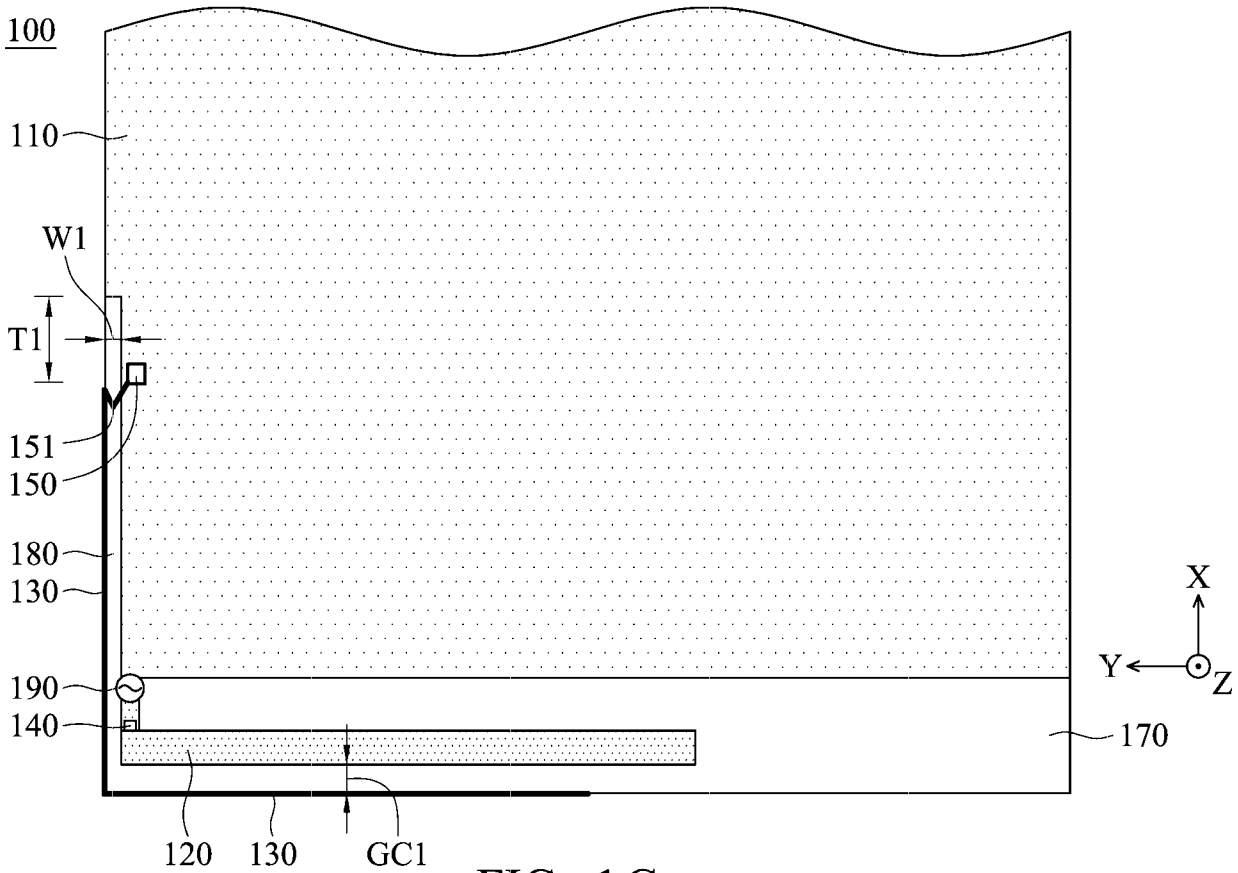
FIG. 1C is a top view of a mobile device according to an embodiment of the invention.

In some embodiments, the mobile device 100 further includes a first circuit element 140 and a second circuit element 150. The first circuit element 140 is embedded in the first radiation branch 120. One end of the second radiation branch 130 is coupled through the second circuit element 150 to the ground plane 110. In order to save the design space, the second circuit element 150 may be disposed within the narrow and long concave region 180. In alternative embodiments, the second circuit element 150 is disposed on the PCB 170, and the second radiation element 130 is coupled through a contact spring 151 and the second circuit element 150 to the ground plane 110 (as shown in FIG. 1C). The first circuit element 140 is configured to adjust the impedance matching and the effective resonant length of the antenna structure. The second circuit element 150 is also configured to adjust the impedance matching and the effective resonant length of the antenna structure, and its detailed composition and function will be described in the following embodiments.

Figure 2:
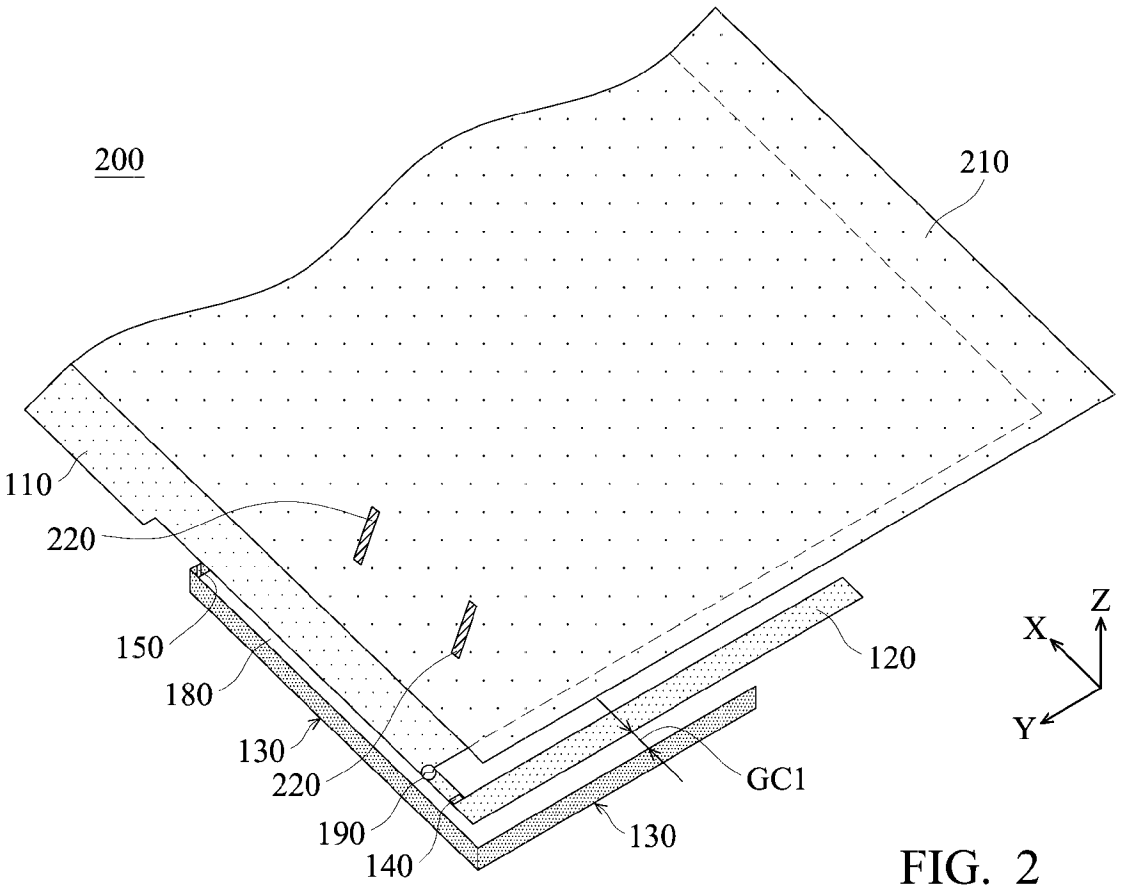
FIG. 2 is a perspective view of a mobile device according to an embodiment of the invention.

FIG. 2 is a perspective view of a mobile device 200 according to an embodiment of the invention. FIG. 2 is similar to FIG. 1A and FIG. 1B. The difference between the two embodiments is that the mobile device 200 further includes a metal back cover 210 and one or more shorting pins 220. The metal back cover 210 is coupled through the shorting pins 220 to the ground plane 110, and therefore the voltage of the metal back cover 210 is substantially equal to that of the ground plane 110. The metal back cover 210 is configured to improve the appearance of the mobile device 200 and provide a fashionable visual effect. However, since the metal back cover 210 is added, it unavoidably affects the radiation pattern and the impedance characteristics of the antenna structure of the mobile device 200. Accordingly, the invention appropriately designs the first circuit element 140 and the second circuit element 150 to adjust the impedance matching of the antenna structure and to eliminate the negative effect caused by the metal back cover 210. Other features of the mobile device 200 of FIG. 2 are similar to those of the mobile device 100 of FIG. 1A and FIG. 1B. Therefore, the two embodiments can achieve similar levels of performance.

Figure 3A:
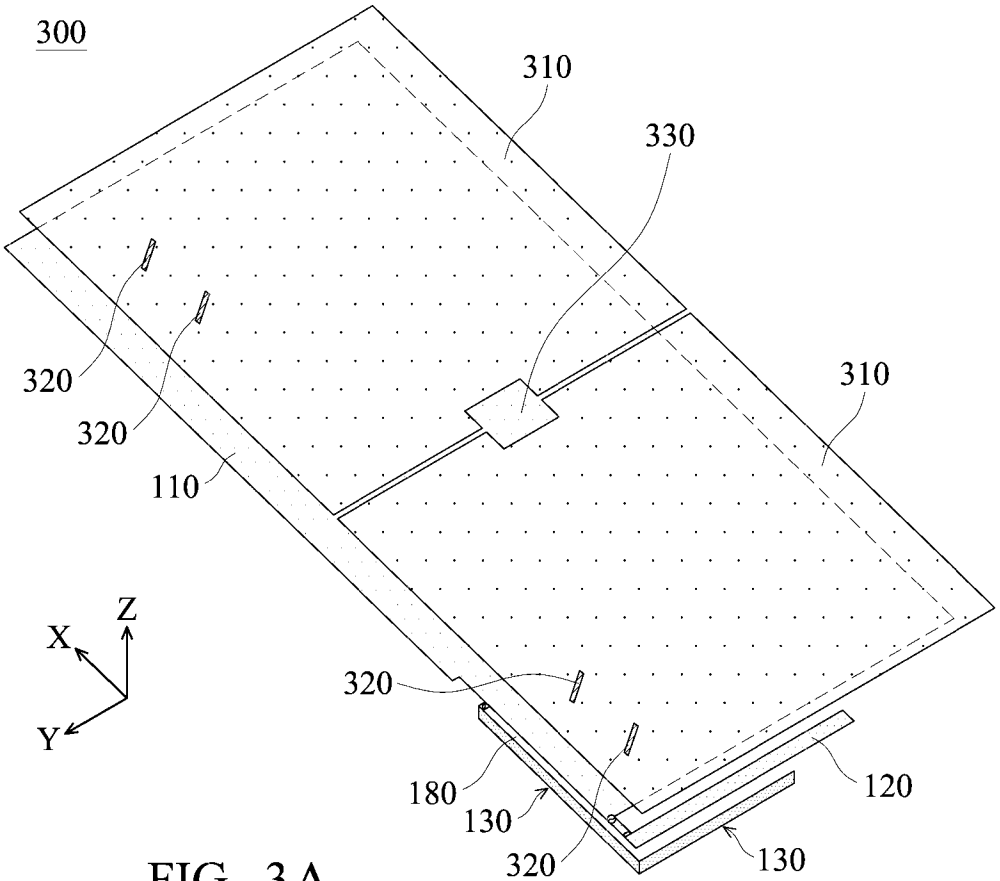
FIG. 3A is a perspective view of a mobile device according to an embodiment of the invention.
Figure 3B:
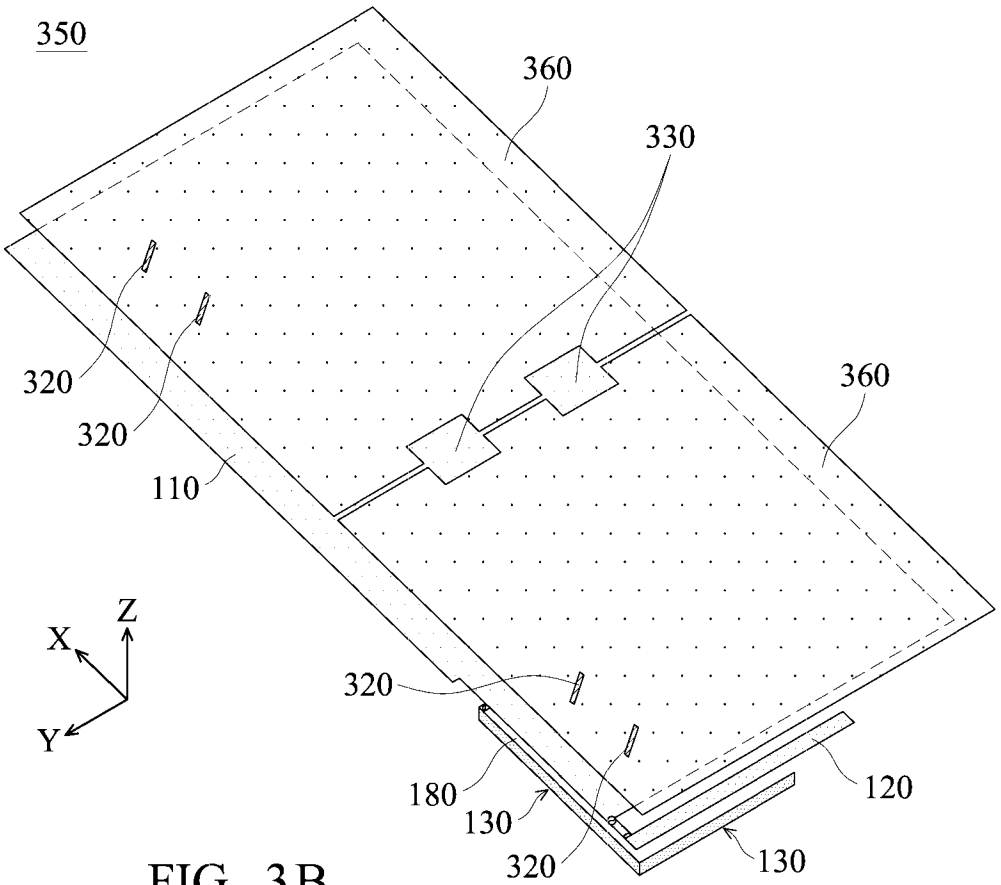
FIG. 3B is a perspective view of a mobile device according to an embodiment of the invention.

FIG. 3A is a perspective view of a mobile device 300 according to an embodiment of the invention. FIG. 3A is similar to FIG. 2. The difference between the two embodiments is that a metal back cover 310 of the mobile device 300 includes two separate portions, and at least one opening 330 is formed between the portions of the metal back cover 310. The opening 330 of the metal back cover 310 substantially has a rectangular shape. The opening 330 is used to accommodate a camera lens, an NFC (Near Field Communication) coil, a flash light module, a biometric identification module, or a wireless charging coil. As a result, the mobile device 300 including the metal back cover 310 can support, for example, the functions of camera, NFC, fingerprint identification, or wireless charging. In alternative embodiments, the opening 330 of the metal back cover 310 has a different shape, such as a circular shape, an elliptical shape, a triangular shape, a square shape, or a trapezoidal shape, to fit other electronic components. FIG. 3B is a perspective view of a mobile device 350 according to an embodiment of the invention. FIG. 3B is similar to FIG. 2. The difference between the two embodiments is that there are multiple openings 330 formed between two separate portions of a metal back cover 360 of the mobile device 350, and these openings 330 may be formed at any position between the portions of the metal back cover 360. Other features of the mobile devices 300 and 350 of FIG. 3A and FIG. 3B are similar to those of the mobile device 200 of FIG. 2. Therefore, these embodiments can achieve similar levels of performance.

Figure 4B:
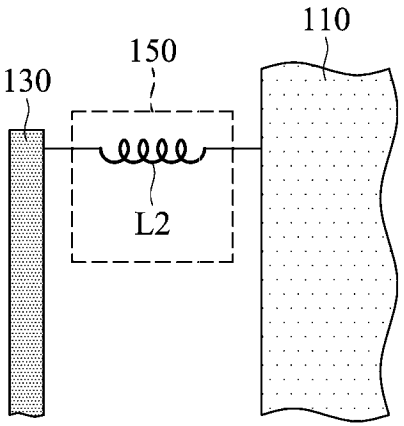
FIG. 4B is a diagram of a second circuit element according to an embodiment of the invention.
Figure 4A:
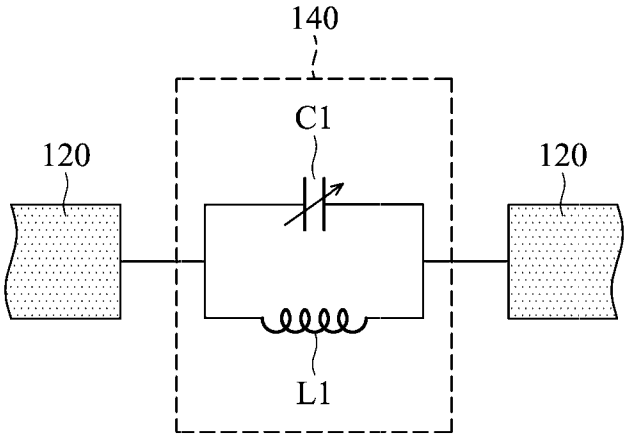
FIG. 4A is a diagram of a first circuit element according to an embodiment of the invention.

FIG. 4A is a diagram of the first circuit element 140 according to an embodiment of the invention. As shown in FIG. 4A, the first circuit element 140 includes a capacitor C1 and a first inductor L1. The capacitor C1 is coupled in parallel to the first inductor L1, and they are both embedded in the first radiation branch 120. In some embodiments, the capacitor C1 is a chip capacitor, and the first inductor L1 is a chip inductor. In some embodiments, the capacitor C1 is a variable capacitor, such as a varactor diode. The capacitance of the capacitor C1 may be adjusted by a processor (not shown) according to a control signal or a user input signal. By changing the capacitance of the capacitor C1, the first circuit element 140 can generate different resonant frequency, so as to control the operation bands of the first radiation branch 120 and the second radiation branch 130. In addition, the capacitor C1 and the first inductor L1 can further provide different impedance values to cancel the effect of the metal back cover adjacent to the antenna structure.

FIG. 4B is a diagram of the second circuit element 150 according to an embodiment of the invention. As shown in FIG. 4B, the second circuit element 150 includes a second inductor L2. In some embodiments, the second inductor L2 is a chip inductor. The second inductor L2 can provide an additional resonant length for the second radiation branch 130, so as to further reduce the size of the antenna structure. In other embodiments, the second circuit element 150 further includes a variable capacitor (not shown). By changing the capacitance of the variable capacitor, the second circuit element 150 can generate different resonant frequency, so as to control the operation bands of the first radiation branch 120 and the second radiation branch 130.

Figure 5A:
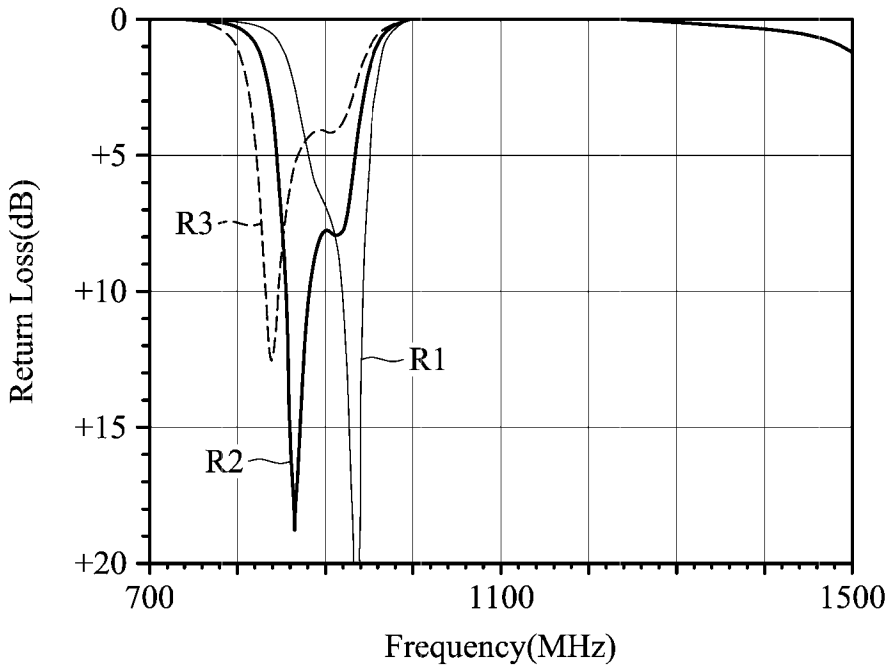
FIG. 5A is a diagram of low-band return loss of an antenna structure of a mobile device according to an embodiment of the invention.

FIG. 5A is a diagram of low-band return loss of the antenna structure of the mobile device 300 according to an embodiment of the invention. The horizontal axis represents operating frequency (MHz), and the vertical axis represents return loss (dB). As mentioned above, the capacitance of the capacitor C1 of the first circuit element 140 is used to control the operation band of the antenna structure. For example, when the capacitor C1 has a first capacitance (e.g., 0.8 pF), the antenna structure operates in a frequency interval from about 880 MHz to about 949 MHz (shown as the return loss curve R1); when the capacitor C1 has a second capacitance (e.g., 1.2 pF), the antenna structure operates in a frequency interval from about 846 MHz to about 934 MHz (shown as the return loss curve R2); and when the capacitor C1 has a third capacitance (e.g., 1.6 pF), the antenna structure operates in a frequency interval from about 825 MHz to about 865 MHz (shown as the return loss curve R3). In some embodiments, the antenna structure can cover a low band from about 698 MHz to about 960 MHz by adjusting the capacitance of the capacitor C1 in a wider range.

Figure 5B:
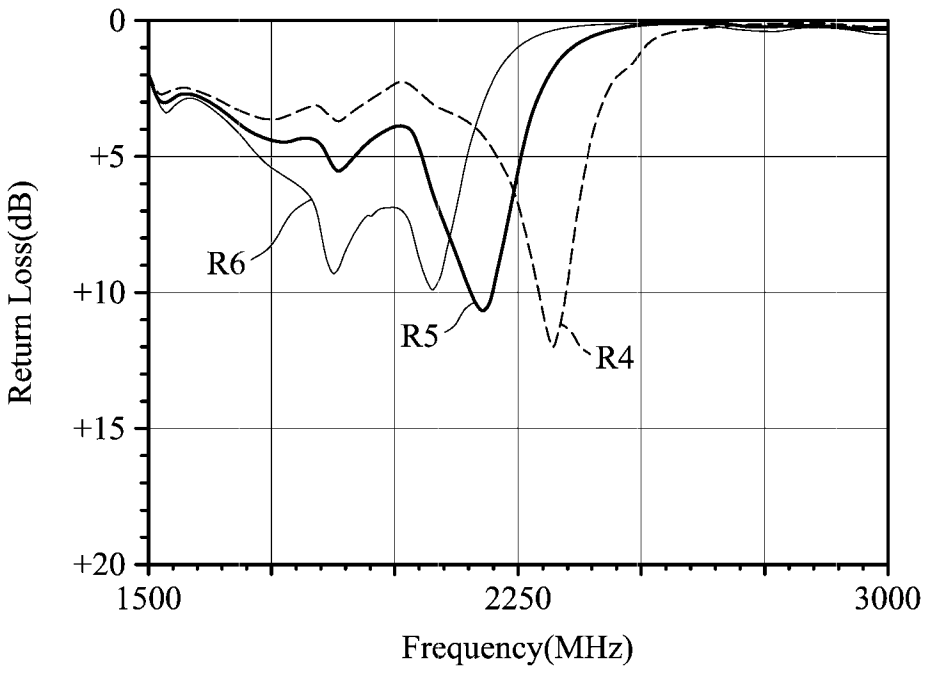
FIG. 5B is a diagram of high-band return loss of an antenna structure of a mobile device according to an embodiment of the invention.

FIG. 5B is a diagram of high-band return loss of the antenna structure of the mobile device 300 according to an embodiment of the invention. The horizontal axis represents operating frequency (MHz), and the vertical axis represents return loss (dB). For example, when the capacitor C1 has a first capacitance (e.g., 0.8 pF), the antenna structure operates in a frequency interval from about 2200 MHz to about 2400 MHz (shown as the return loss curve R4); when the capacitor C1 has a second capacitance (e.g., 1.2 pF), the antenna structure operates in a frequency interval from about 2050 MHz to about 2250 MHz (shown as the return loss curve R5); and when the capacitor C1 has a third capacitance (e.g., 1.6 pF), the antenna structure operates in a frequency interval from about 1720 MHz to about 2146 MHz (shown as the return loss curve R6). In some embodiments, the antenna structure can cover a high band from about 1710 MHz to about 2690 MHz by adjusting the capacitance of the capacitor C1 in a wider range.

Please refer to FIGS. 1A and 1B again. In some embodiments, the element sizes and element parameters of the mobile device 100 are as follows. The first radiation branch 120 has a length of about 44 mm. The second radiation branch 130 has a length of about 69 mm. The narrow and long concave region 180 has a width W1 of about 1.2 mm. The spacing T1 between the second circuit element 150 and the short edge of the narrow and long concave region 180 is at least 3 mm, and it is designed to prevent the leakage phenomenon between the second radiation branch 130 and the ground plane 110. The capacitor C1 has a capacitance from about 0.6 pF to 4 pF, and the capacitance is preferably equal to 0.9 pF, 1.5 pF, or 2.7 pF. The first inductor L1 has an inductance from about 6 nH to 12 nH, and the inductance is preferably equal to 8.2 nH. The second inductor L2 has an inductance from about 7 nH to 15 nH, and the inductance is preferably equal to 10 nH. With such a design, the mobile device 100 including the metal back cover may merely have a thickness of about 5.2 mm, and is suitable for application in a variety of ultra-thin structure designs.

Figure 6:
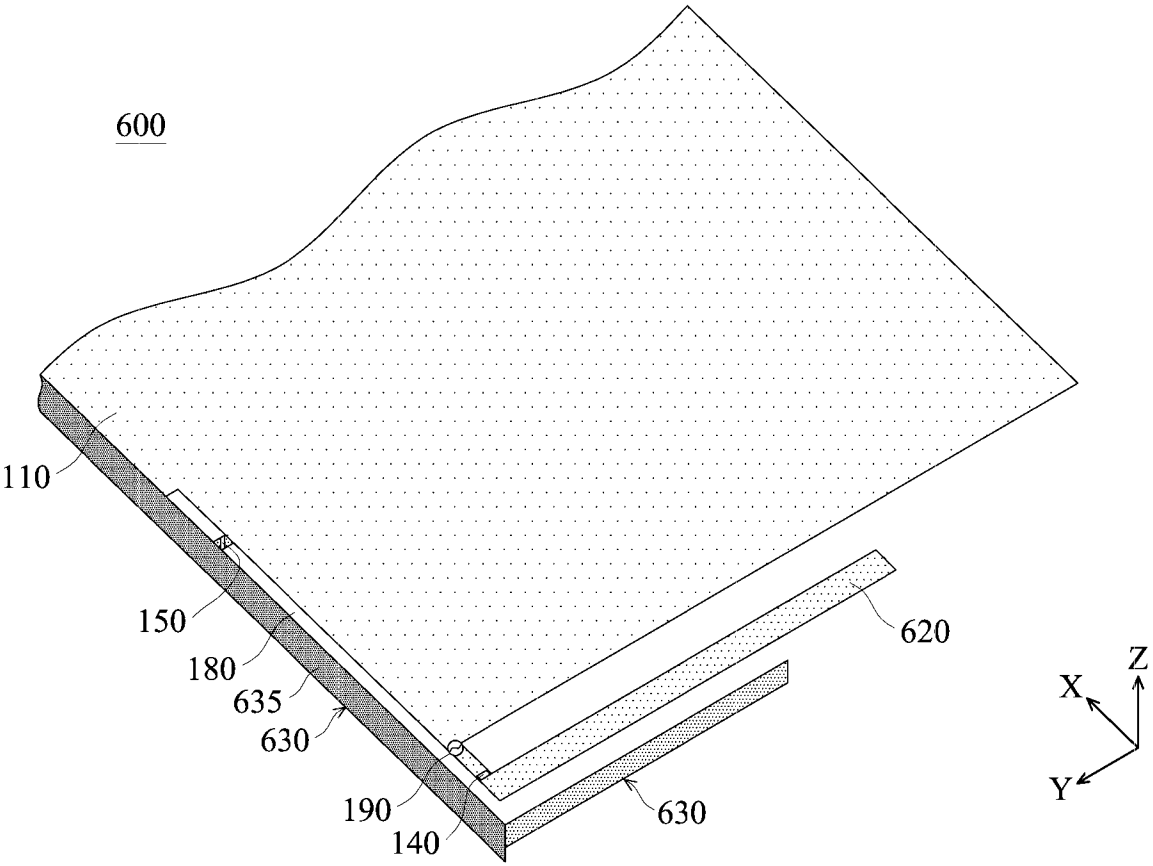
FIG. 6 is a perspective view of a mobile device according to an embodiment of the invention.

FIG. 6 is a perspective view of a mobile device 600 according to an embodiment of the invention. FIG. 6 is similar to FIG. 1A and FIG. 1B. The difference between the two embodiments is that at least one portion of a second radiation branch 630 of the mobile device 600 is implemented with a side appearance element 635, such as a metal bezel. The side appearance element 635 is made of conductive materials, and is disposed on an external surface of a housing (not shown) of the mobile device 600. The side appearance element 635 is coupled through the second circuit element 150 to the ground plane 110, so as to form a portion of the second radiation branch 630. With such a design, the side appearance element 635 can not only improve the appearance of the mobile device 600 but also form a portion of the antenna structure of the mobile device 600. Other features of the mobile device 600 of FIG. 6 are similar to those of the mobile device 100 of FIG. 1A and FIG. 1B. Therefore, the two embodiments can achieve similar levels of performance.

Figure 7A:
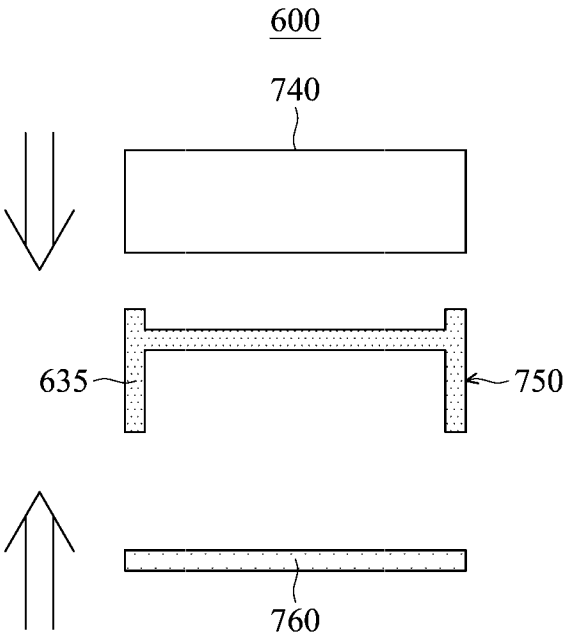
FIG. 7A is an exploded side view of a mobile device according to an embodiment of the invention.
Figure 7C:
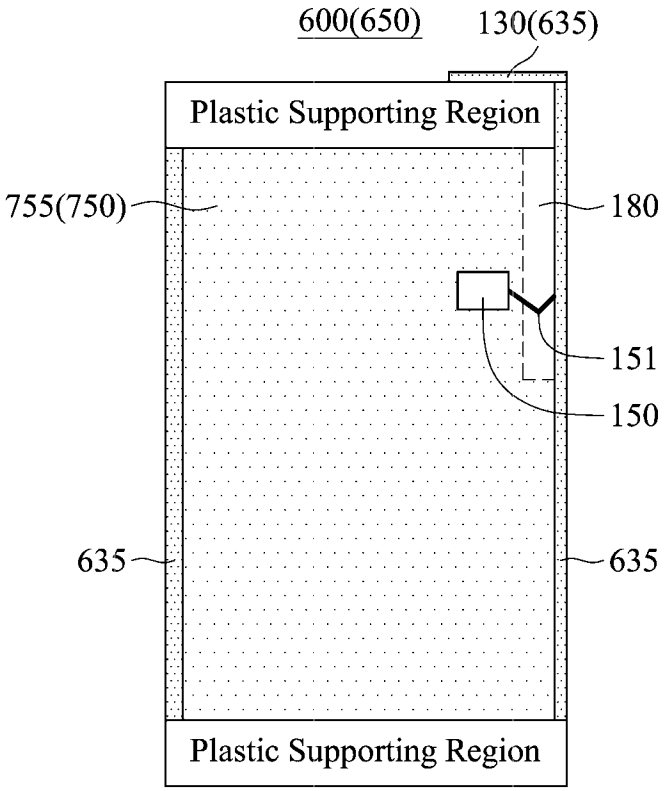
FIG. 7C is a top view of a mobile device according to an embodiment of the invention.

FIG. 7A is an exploded side view of the mobile device 600 according to an embodiment of the invention. As shown in FIG. 7A, the mobile device 600 further includes a display device 740, a display-carrying element 750, and a metal back cover 760. The display-carrying element 750 is made of conductive materials, and is used to carry the display device 740, such as an LCD (Liquid Crystal Display). It should be understood that in order to simplify the drawing, FIG. 7A does not show other components of the mobile device 600. The display-carrying element 750 is disposed between the display device 740 and the metal back cover 760, and the aforementioned PCB 170 (not shown) is disposed between the display-carrying element 750 and the metal back cover 760. At least two side stopping portions of the display-carrying element 750 may further extend toward the metal back cover 760, so as to form the side appearance element 635. In other words, the side appearance element 635 may be an extension portion of the two side stopping portions of the display-carrying element 750. In some embodiments, the display-carrying element 750 and the metal back cover 760 are two independent elements which are separate from each other. In alternative embodiments, the display-carrying element 750 is integrated with the metal back cover 760 to form an AIO (All-In-One) element.

FIG. 7B is an exploded side view of a mobile device 650 according to an embodiment of the invention. FIG. 7B is similar to FIG. 7A. The difference between the two embodiments is that, in the mobile device 650, at least two opposite sides of a metal back cover 765 are bent toward a display-carrying element 755, so as to form the side appearance element 635. In other words, the side appearance element 635 may be an extension portion (i.e., the bent-edge portions) of the metal back cover 765. Other features of the mobile device 650 of FIG. 7B are similar to those of the mobile device 600 of FIG. 7A. Therefore, the two embodiments can achieve similar levels of performance.

FIG. 7C is a top view of a mobile device 600 (650) according to the embodiments of FIGS. 7A and 7B. Please refer to FIG. 7A, FIG. 7B, and FIG. 7C together to understand the invention.

Figure 8:
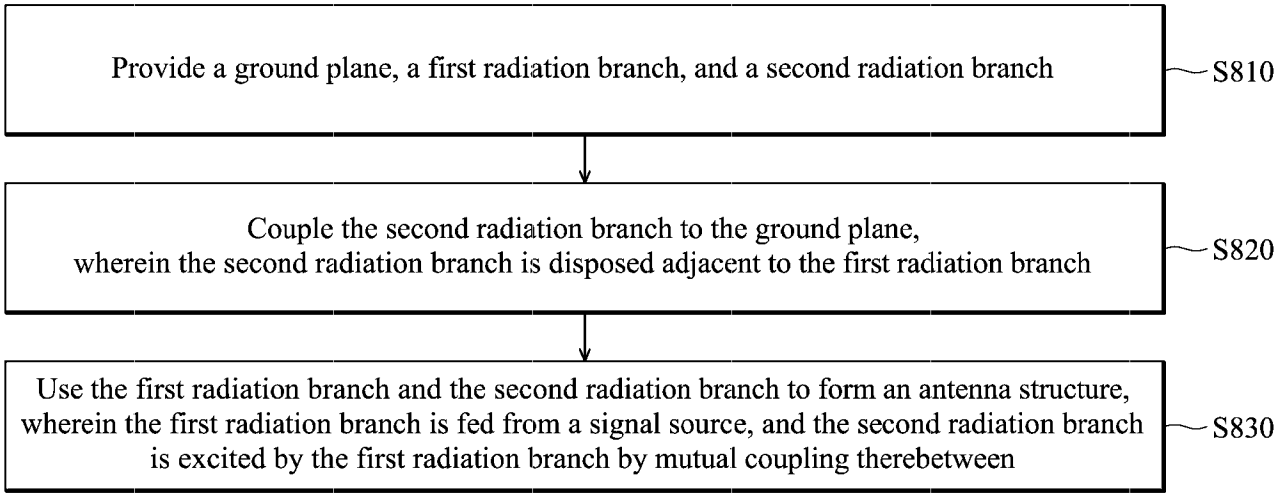
FIG. 8 is a flowchart of a method for manufacturing a mobile device according to an embodiment of the invention.

FIG. 8 is a flowchart of a method for manufacturing a mobile device according to an embodiment of the invention. The method includes at least the following steps. In step S810, a ground plane, a first radiation branch, and a second radiation branch are provided. In step S820, the second radiation branch is coupled to the ground plane. The second radiation branch is disposed adjacent to the first radiation branch. In step S830, the first radiation branch and the second radiation branch are used to form an antenna structure. The first radiation branch is fed from a signal source. The second radiation branch is excited by the first radiation branch through mutual coupling therebetween.

Figure 9:
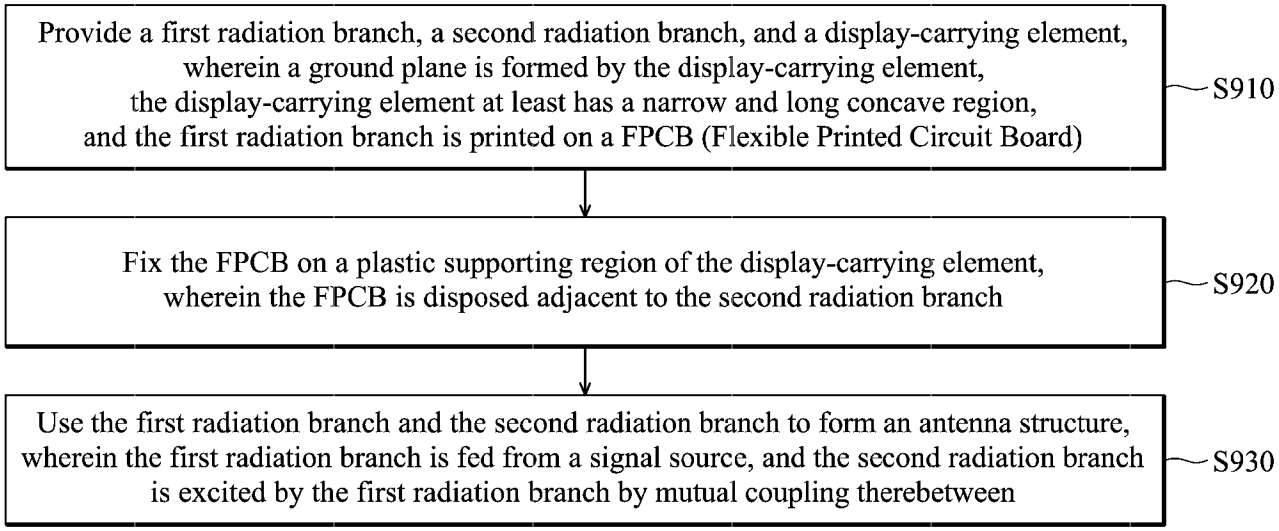
FIG. 9 is a flowchart of a method for manufacturing a mobile device according to an embodiment of the invention.

FIG. 9 is a flowchart of a method for manufacturing a mobile device according to an embodiment of the invention. The method at least includes the following steps. In step S910, a first radiation branch, a second radiation branch, and a display-carrying element are provided. A ground plane is formed by the display-carrying element. The display-carrying element at least has a narrow and long concave region. The first radiation branch is printed on a FPCB (Flexible Printed Circuit Board). In step S920, the FPCB is fixed on a plastic supporting region of the display-carrying element. The FPCB is disposed adjacent to the second radiation branch. In step S930, the first radiation branch and the second radiation branch are used to form an antenna structure. The first radiation branch is fed from a signal source. The second radiation branch is excited by the first radiation branch through mutual coupling therebetween.

It should be understood that the above steps are not required to be performed in order, and any one or more device features of the embodiments of FIGS. 1A to 7B may be applied to the method of the embodiments of FIG. 8 and FIG. 9.

The invention provides an antenna structure for use in a mobile device with a metal back cover. According to some measurement results, the invention has at least the following advantages of (1) enhancing the antenna efficiency, (2) reducing the power consumption, (3) reducing the manufacturing cost, (4) minimizing the whole size of the mobile device and the antenna structure, and (5) being easily integrated with a variety of functional modules, in comparison to the conventional design. Therefore, the invention can meet the requirements of current trends in mobile devices, such as being thin and fashionable design, and having high antenna efficiency characteristics.

Note that the above element sizes, element shapes, element parameters, and frequency ranges are not limitations of the invention. An antenna designer can fine-tune these settings or values according to different requirements. It is understood that the mobile device and the antenna structure of the invention are not limited to the configurations of FIGS. 1A to 9. The invention may merely include any one or more features of any one or more embodiments of FIGS. 1A to 8. In other words, not all of the features displayed in the figures should be implemented in the mobile device and the antenna structure of the invention.

Use of ordinal terms such as "first", "second", "third", etc., in the claims to modify a claim element does not by itself connote any priority, precedence, or order of one claim element over another or the temporal order in which acts of a method are performed, but are used merely as labels to distinguish one claim element having a certain name from another element having the same name (but for the ordinal term) to distinguish the claim elements.

The embodiments of the disclosure are considered as exemplary only, not limitations. It will be apparent to those skilled in the art that various modifications and variations can be made in the invention, the true scope of the disclosed embodiments being indicated by the following claims and their equivalents.

What is claimed is:

1. A mobile device, comprising:

a ground plane;

a first radiation branch; and a second radiation branch, coupled to the ground plane, and disposed adjacent to the first radiation branch;

wherein an antenna structure is formed by the first radiation branch and the second radiation branch, the first radiation branch is fed from a signal source, and the second radiation branch is excited by the first radiation branch through coupling therebetween;

wherein the mobile device further comprises:

a metal back cover, disposed opposite to the ground plane; and one or more shorting pins, wherein the metal back cover is coupled through the shorting pins to the ground plane, wherein the metal back cover consists of two portions which are completely separate from each other, wherein a first opening and a second opening are respectively formed between the two portions of the metal back cover, and wherein each of the first opening and the second opening has a triangular shape, a square shape, or a trapezoidal shape.

2. The mobile device as claimed in claim 1, wherein each of the first opening and the second opening is used to accommodate a camera lens, an NFC (Near Field Communication) coil, a flash light module, a biometric identification module, or a wireless charging coil.

3. The mobile device as claimed in claim 1, further comprising:

a first circuit element, embedded in the first radiation branch.

4. The mobile device as claimed in claim 3, wherein the first circuit element comprises a capacitor and a first inductor, and the capacitor is coupled in parallel to the first inductor.

5. The mobile device as claimed in claim 4, wherein the capacitor is a variable capacitor.

6. The mobile device as claimed in claim 1, further comprising:

a second circuit element, wherein one end of the second radiation branch is coupled through the second circuit element to the ground plane.

7. The mobile device as claimed in claim 6, wherein the second circuit element comprises a second inductor.

8. The mobile device as claimed in claim 1, wherein the first radiation branch substantially has an L-shape.

9. The mobile device as claimed in claim 1, wherein the second radiation branch substantially has an L-shape.

10. The mobile device as claimed in claim 1, wherein a width of a coupling gap between the first radiation branch and the second radiation branch is shorter than 6 mm.

11. The mobile device as claimed in claim 1, wherein the ground plane is disposed on a PCB (Printed Circuit Board), or is implemented with a display-carrying element.

12. The mobile device as claimed in claim 1, wherein the ground plane substantially has a rectangular shape with a narrow and long concave region, and the narrow and long concave region is a metal-free region adjacent to the second radiation branch.

13. The mobile device as claimed in claim 12, wherein at least one portion of the second radiation branch is disposed within the narrow and long concave region.

14. The mobile device as claimed in claim 12, further comprising:

a second circuit element, wherein one end of the second radiation branch is coupled through the second circuit element to the ground plane, and spacing between a short edge of the narrow and long concave region and the end of the second radiation branch is at least 3 mm.

15. The mobile device as claimed in claim 1, wherein the first radiation branch is disposed on a first plane, the second radiation branch is disposed on a second plane and a third plane, and the second plane and the third plane are both perpendicular to the first plane.

16. The mobile device as claimed in claim 1, wherein the first radiation branch is disposed on a PCB (Printed Circuit Board).

17. The mobile device as claimed in claim 1, wherein at least one portion of the second radiation branch is implemented with a side appearance element.

18. The mobile device as claimed in claim 17, wherein the side appearance element is an extension portion of a display-carrying element.

19. The mobile device as claimed in claim 17, wherein the side appearance element is an extension portion of a metal back cover.

20. The mobile device as claimed in claim 1, wherein the antenna structure is configured to cover a first band and a second band, the first band is from about 698 MHz to about 960 MHz, and the second band is from about 1710 MHz to about 2690 MHz.

21. A method for manufacturing a mobile device, comprising the steps of:

providing a ground plane, a first radiation branch, and a second radiation branch;

coupling the second radiation branch to the ground plane, wherein the second radiation branch is disposed adjacent to the first radiation branch;

using the first radiation branch and the second radiation branch to form an antenna structure, wherein the first radiation branch is fed from a signal source, and the second radiation branch is excited by the first radiation branch through coupling therebetween;

providing a metal back cover, wherein the metal back cover is disposed opposite to the ground plane; and coupling the metal back cover through one or more shorted-circuit elements to the ground plane, wherein the metal back cover consists of two portions which are completely separate from each other, wherein a first opening and a second opening are respectively formed between the two portions of the metal back cover, and wherein each of the first opening and the second opening has a triangular shape, a square shape, or a trapezoidal shape.

22. The method as claimed in claim 21, further comprising:

embedding a first circuit element in the first radiation branch; and coupling one end of the second radiation branch through a second circuit element to the ground plane.

23. The method as claimed in claim 22, wherein the first circuit element comprises a capacitor and a first inductor, the capacitor is coupled in parallel to the first inductor, and the second circuit element comprises a second inductor.

* * * * *